US006598872B1

(12) United States Patent
Gunschera et al.

(10) Patent No.: US 6,598,872 B1
(45) Date of Patent: Jul. 29, 2003

(54) SHEET BRAKING DEVICE WITH REPLACEABLE SUPPORT ELEMENT

(75) Inventors: Frank Gunschera, Nussloch (DE); Sven Kerpe, Bruchsal (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/366,353

(22) Filed: Aug. 3, 1999

(30) Foreign Application Priority Data

Aug. 3, 1998 (DE) ..... 198 35 003

(51) Int. Cl.[7] ..... B65H 29/68

(52) U.S. Cl. ..... 271/197; 271/202; 271/182; 271/183

(58) Field of Search ..... 271/182, 183, 271/197, 202, 231; 198/688.1, 689.1, 817

(56) References Cited

U.S. PATENT DOCUMENTS

| | | | | |
|---|---|---|---|---|
| 3,328,027 A | * | 6/1967 | Schmidtke | 271/183 |
| 3,432,161 A | * | 3/1969 | Dale et al. | 271/183 |
| 4,225,129 A | * | 9/1980 | Zimmermann et al. | 271/183 X |
| 4,625,956 A | * | 12/1986 | Marass et al. | 271/183 |
| 4,693,462 A | * | 9/1987 | Pollich | 271/183 |
| 5,397,120 A | * | 3/1995 | Schulz et al. | 271/198 |
| 5,569,016 A | * | 10/1996 | Mokler | 271/183 X |
| 5,671,920 A | * | 9/1997 | Acquaviva et al. | 271/182 X |
| 5,829,740 A | * | 11/1998 | Kerpe et al. | 271/197 X |
| 5,873,155 A | * | 2/1999 | Jokela | 198/817 X |

FOREIGN PATENT DOCUMENTS

| | | | |
|---|---|---|---|
| DE | 26 27 812 | | 12/1977 |
| DE | 4017017 | * | 1/1991 |
| DE | 288 581 A5 | | 4/1991 |
| DE | 40 35 037 C2 | | 5/1996 |
| DE | 196 16 423 A1 | | 11/1997 |
| EP | 0 004 264 A1 | | 10/1979 |

* cited by examiner

*Primary Examiner*—Patrick H. Mackey
(74) *Attorney, Agent, or Firm*—Laurence A. Greenberg; Werner H. Stemer; Ralph E. Locher

(57) ABSTRACT

A delivery for a printing machine that processes sheets passing through the latter in a processing direction, includes sheet brakes adjustable transversely to the processing direction and a respective braking element having a vacuum passing therethrough, the braking element being cooperatable with the sheet and revolving during the operation thereof, and a supporting element through which vacuum does not pass, the respective braking element being replaceable by the supporting element for converting one of the sheet brakes to a respective sheet support adjustable transversely to the processing direction; and a printing machine having such a delivery.

14 Claims, 3 Drawing Sheets

SHEET BRAKING DEVICE WITH REPLACEABLE SUPPORT ELEMENT

BACKGROUND OF THE INVENTION

Field of the Invention

The invention relates to a delivery for a printing machine that processes sheets passing through the latter in a processing direction, including sheet brakes which are adjustable transversely to the processing direction, and which, respectively, are made up of a braking element having a vacuum passing therethrough, the braking element being cooperatable with the sheet and revolving during the operation thereof, and sheet supports adjustable transversely to the processing direction. The invention also relates to a sheet-processing printing machine equipped with a delivery of the foregoing type.

A delivery of the type referred to in the introduction hereto is disclosed by the German Published Non-prosecuted Patent Application (DE-OS) 26 27 812. The braking elements disclosed therein, which revolve when operating, are made up of suction wheels which are constructed in the form of hollow wheels. A respective hollow wheel is mounted on a journal of a suction-wheel holder. As the hollow wheel revolves during operation, a cylindrical inner surface of the hollow wheel slides over a contact surface of the suction-wheel holder. A borehole formed in the contact surface is connected to a suction pipe and communicates with radial boreholes formed in the hollow wheel, the radial boreholes succeeding one another in the peripheral direction of the hollow wheel, so that the braking element, constructed in the form of the hollow wheel, is traversed by a vacuum that prevails in the suction pipe. In order to adjust the sheet brakes formed by the suction wheels transversely to the processing direction, the suction-wheel holders are pushed onto a cross member arranged transversely to the processing direction, and can be fixed by setscrews in a respectively required position with regard to the cross member. In order to drive the suction wheels, a shaft with a square cross section which passes through the suction-wheel holders is provided, and engages in a form-locking manner in the hub region of a respective suction wheel. In this regard, it is noted that a form-locking connection is one which connects two elements together due to the shape of the elements themselves, as opposed to a force-locking connection, which locks the elements together by force external to the elements.

The sheet supports provided in the heretofore known delivery are connected in a form-locking manner to the aforementioned so-called square shaft and are displaceable along the square shaft by applying an adjusting force that overcomes a frictional connection between the shaft and the sheet supports, so that the sheet supports are likewise adjustable transversely to the processing direction. A respective sheet support is formed by a pair of carrying disks which are spaced apart from one another and provide a rotational mounting for satellite spur wheels distributed over the periphery thereof and projecting beyond the carrying disks.

In particular, when a printing machine is operating in a recto/verso or first-form and perfecter printing process mode, the sheet brakes can be placed so that the braking elements act only upon print-free corridors of the sheets to be braked. For the case wherein, during a printing job, the sheets have fewer print-free corridors, which are of adequate width for a braking element to act, than sheet brakes, it is not possible to use all of the latter. It is apparent for such a case that, with the aforementioned heretofore known delivery, provision is made to connect the suction wheels selectively to a suction pipe and to a compressed-air pipe, respectively, so that apparently through the intermediary of blown air flowing out of a suction wheel, contact between the suction wheel and the sheet is avoided when there is no print-free corridor of the sheets opposite the suction wheel. This appears to be problematic, however, particularly in the case of rapidly succeeding sheets, inasmuch as those sheets normally have powerful blown-air flows applied thereto on the side thereof facing away from the sheet brakes, specifically in order to achieve a rapid lowering of the sheets released from the sheet brakes and, thus, to avoid collisions between the successive sheets. It is therefore suggested rather to remove the superfluous sheet brakes from the area over which the sheets sweep.

For the case wherein the sheets have a format that is smaller than the maximum format printable by the printing machine, if necessary or desirable, the superfluous sheet brakes outside the format can be moved into a parking position, if disassembly is not an acceptable alternative. A given outlay for disassembly and assembly has already been incurred for this purpose, inasmuch as the sheet supports which are in the way of any displacement of sheet brakes from the area over which the sheets sweep into a position outside the area, initially have to be disassembled and reassembled after the displacement of the sheet brakes has occurred.

In the case of printing sheets with the maximum possible format for the printing machine, however, if a given number of sheet brakes prove to be superfluous, generally these cannot be displaced into a position outside the format, so that they either have to be disassembled or brought reliably out of contact with the sheets in another way. A measure that is suitable therefor and is an alternative to disassembly, and to which recourse is certainly had in practice, includes, for example, the provision of additional sheet supports, specifically in the form of conventional spur-wheel arrangements, on either side of a superfluous sheet brake and closely adjacent to the latter. However, in this type of application thereof, these sheet supports must project beyond the sheet brake in the direction of the sheets. In this regard, however, a given marking of the printed image by the spur-wheel arrangements generally has to be taken into account.

In any case, however, a relatively high outlay is needed to implement the arrangement of the sheet brakes and of the sheet supports required for a respective printing job.

Furthermore, it is apparent from the arrangement of the sheet brakes and the sheet supports provided in the aforementioned delivery, that these can impede one another during the adjustment thereof transversely to the processing direction. Although this could be countered by providing only a very small number of sheet supports, the consequence thereof would be that it would not be possible to print at the high processing speed that is common in modern printing machines. This is because, in this case, due to the powerful blown-air flows, which are required in this case and have already been mentioned, on that side of the respective sheets which faces away from the sheet brakes, there would result a relatively large amount of sagging of the sheets between the sheet brakes, with the risk of smearing the printed image on that side of the respective sheets which faces the sheet brakes.

SUMMARY OF THE INVENTION

It is accordingly an object of the invention to provide a printing-machine delivery of the general type mentioned in the introduction hereto that is configured in such a manner that the sheet brakes and sheet supports thereof are adaptable to different printing jobs with a relatively low outlay or expense for conversion.

With the foregoing and other objects in view, there is provided, in accordance with one aspect of the invention, a delivery for a printing machine that processes sheets passing through the latter in a processing direction, comprising sheet brakes adjustable transversely to the processing direction and, respectively, including a braking element having a vacuum passing therethrough, the braking element being cooperatable with the sheet and revolving during the operation thereof, and a supporting element through which vacuum does not pass, the respective braking element being replaceable by the supporting element for converting one of the sheet brakes to a respective sheet support adjustable transversely to the processing direction.

In accordance with another feature of the invention, the delivery includes a plurality of the sheet brakes and the sheet supports, the sheet brakes and the sheet supports being servomotively adjustable.

In accordance with a further feature of the invention, a respective braking element is formed as an endless suction belt, and a respective supporting element is formed as an endless supporting belt, the supporting belt having a cross section forming an elevation or rise on the outside of the supporting belt.

In accordance with another aspect of the invention, there is provided a sheet-processing printing machine, comprising a delivery having at least one of the foregoing features.

A configuration of the foregoing type according to the invention shortens from many points of view the fitting time for adapting the sheet brakes and the sheet supports to the respective printing job; specifically, in order to implement the functions of braking the sheets, on the one hand, and the support of the sheets, on the other hand, it is only necessary to replace a functional part on one of otherwise identical basic functional units, and superfluous sheet brakes, if appropriate, do not need to be disassembled, because sheet brakes and sheet supports can be formed in any desired sequence transversely to the processing direction. For example, a basic functional unit constructed as a sheet brake, in a preceding print job can be converted, if required, into a sheet support or, while maintaining the function thereof, can be displaced from a previously assumed position thereof into a different position, while a sheet brake previously positioned at a different location, can assume a position which has become free, and thereat, after the braking element thereof has been replaced by a supporting element, can act as a sheet support.

One development provides for the sheet brakes and the sheet supports to be servomotively adjustable. This is possible as a result of the configuration according to the invention, without risk of mutual collision, because the succession of sheet brakes and sheet supports transversely to the processing direction can be selected as desired, due to the ability of the basic functional units to be converted.

In a preferred refinement, a respective braking element is formed as an endless suction belt, and a respective supporting element is formed as an endless supporting belt, and the supporting belt has a cross section which forms an elevation or rise on the outside of the supporting belt. In this case, it is further preferred for both the suction belt and the supporting belt to be elastic in the peripheral direction thereof and dimensioned so that when these belts are mounted or assembled, without using a tensioning device, they are set under a tension in the peripheral direction that is adequate for the intended use of the suction or supporting belt.

Other features which are considered as characteristic for the invention are set forth in the appended claims.

Although the invention is illustrated and described herein as embodied in a delivery for a printing machine, and a printing machine equipped with such a delivery, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
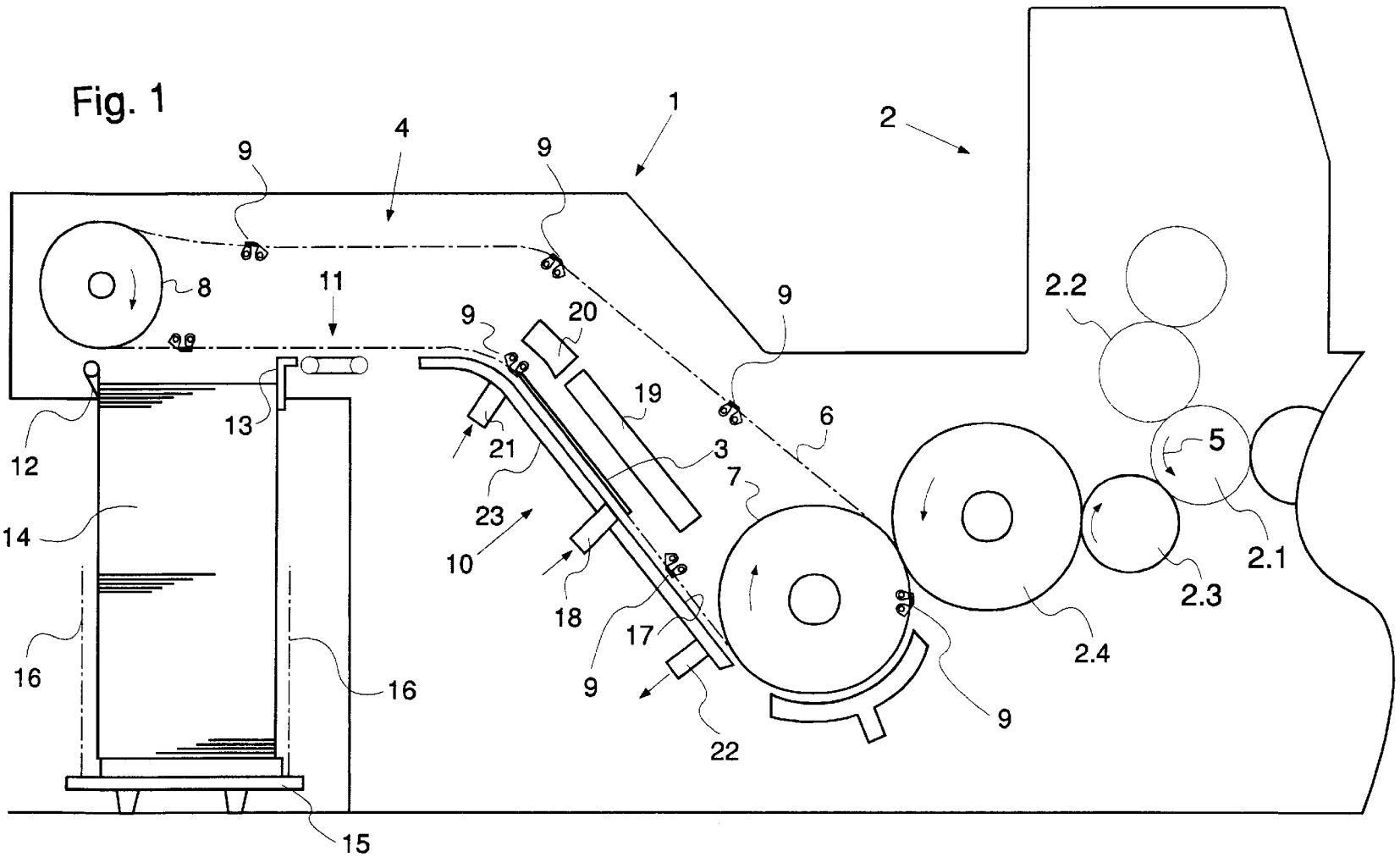
FIG. 1 is a fragmentary diagrammatic side elevational view of a sheet-processing printing machine, showing an end section thereof wherein a delivery is disposed downline from a last processing station of the printing machine.

Referring now to the drawings and, first, particularly to the diagrammatic view of FIG. 1, there is shown therein a delivery 1 adjoining a last processing station of a printing machine, as viewed in the processing direction. Such a processing station may be a printing unit or a post-treatment unit, such as a varnishing unit, for example. In the embodiment at hand, the last processing station is a printing unit 2 operating in an offset process and having an impression cylinder 2.1. The latter guides a respective sheet 3, in a processing direction represented by a direction-of-rotation arrow 5, through a printing nip between the impression cylinder 2.1 and a blanket cylinder 2.2 cooperating with the latter and, in the embodiment of FIG. 1, then transferring the sheet 3 to a row of grippers of a single-revolution transfer drum 2.3, while opening a row of grippers arranged on the impression cylinder 2.1 and provided for gripping the sheet 3 at a gripper margin located at a leading end of the sheet 3. An appropriate transfer of the sheet 3 then takes place from the single-revolution transfer drum 2.3 to a further transfer drum 2.4 that is a half-revolution transfer drum in this embodiment, that finally transfers the sheet 3 to a chain conveyor 4 of the delivery 1. The chain conveyor 4 includes two endless conveyor chains 6, each of which, when operating, revolving along a closed chain path in the vicinity of a respective side wall of the chain delivery 1. A respective conveyor chain 6 wraps around a respective one of two synchronously driven drive sprockets 7 having axes aligned with one another and, in the embodiment of FIG. 1, is led over a respective deflection sprocket 8 that is located downline from the drive sprockets 7, as viewed in the processing direction, so that each of the conveyor chains 6 runs through a closed chain path. Between the two conveyor chains 6, there extend gripper systems 9, which are carried by the conveyor chains 6 and have grippers which pass through gaps between grippers arranged on the transfer drum 2.4 and, in the process, accept a respective sheet 3 by gripping the aforementioned gripper margin at the leading end of the sheet 3 directly before the grippers arranged on the transfer drum 2.4 are opened, transport the sheet over a sheet guiding device 10 to a braking station 11 and open after the sheet 3 has been transferred to the braking station 11. In the braking station 11, the sheets are braked to a depositing speed that is reduced with respect to the processing speed and, after reaching the depositing speed, are finally released, so that a respective sheet 3, that has then been slowed down, finally encounters leading-edge stops 12 and, while being aligned with the latter and with trailing-edge stops 13 opposite them, forms a sheet pile 14 with preceding and/or following sheets 3, it being possible for the sheet pile 14 to be lowered by a lifting unit to an extent corresponding to the growth of the sheet pile 14. In the interest of clarity, the lifting unit is represented in FIG. 1 only by a platform 15 thereof carrying the sheet pile 14, and by lifting chains 16 carrying the platform 15 and shown in phantom, i.e., by dot-dash lines.

The conveyor chains 6 are guided along the path thereof between the drive sprockets 7, on the one hand, and the deflection sprockets 8, on the other hand, by chain guide rails, which determine the chain paths of the chain strands or runs. In the embodiment of FIG. 1, the sheets 3 are transported by the lower chain strand or run. The section of the chain path through which the chain strand or run passes is followed by a sheet guiding surface 17 facing towards the section, the sheet guiding surface being formed on the sheet guiding device 10. During operation, a supporting air cushion is preferably formed between the sheet guiding surface 17 and the respective sheet 3 led over it. For this purpose, the sheet guiding device 10 is equipped with symbolically illustrated blown-air nozzles 18 (only one of which is shown in FIG. 1) which open into the sheet guiding surface 17.

In order to prevent the printed sheets in the pile 14 from sticking or adhering to one another, a dryer 19 and a powdering or powder spraying device 20 are provided on the path of the sheets 3 from the drive sprockets 7 to the braking station 11.

In order to avoid excessive heating of the sheet guiding surface 17 by the dryer 19, a coolant circuit is integrated in the sheet guiding device 10, the coolant circuit being represented symbolically in FIG. 1 by an inlet nozzle 21 and an outlet nozzle 22 on a coolant trough 23 associated with the sheet guiding surface 17.

No illustration of the aforementioned chain guide rails has been provided in FIG. 1. However, the course of the latter in the embodiment at hand is believed to be apparent from the illustrated course of the chain strands or runs 6.

Figure 2:
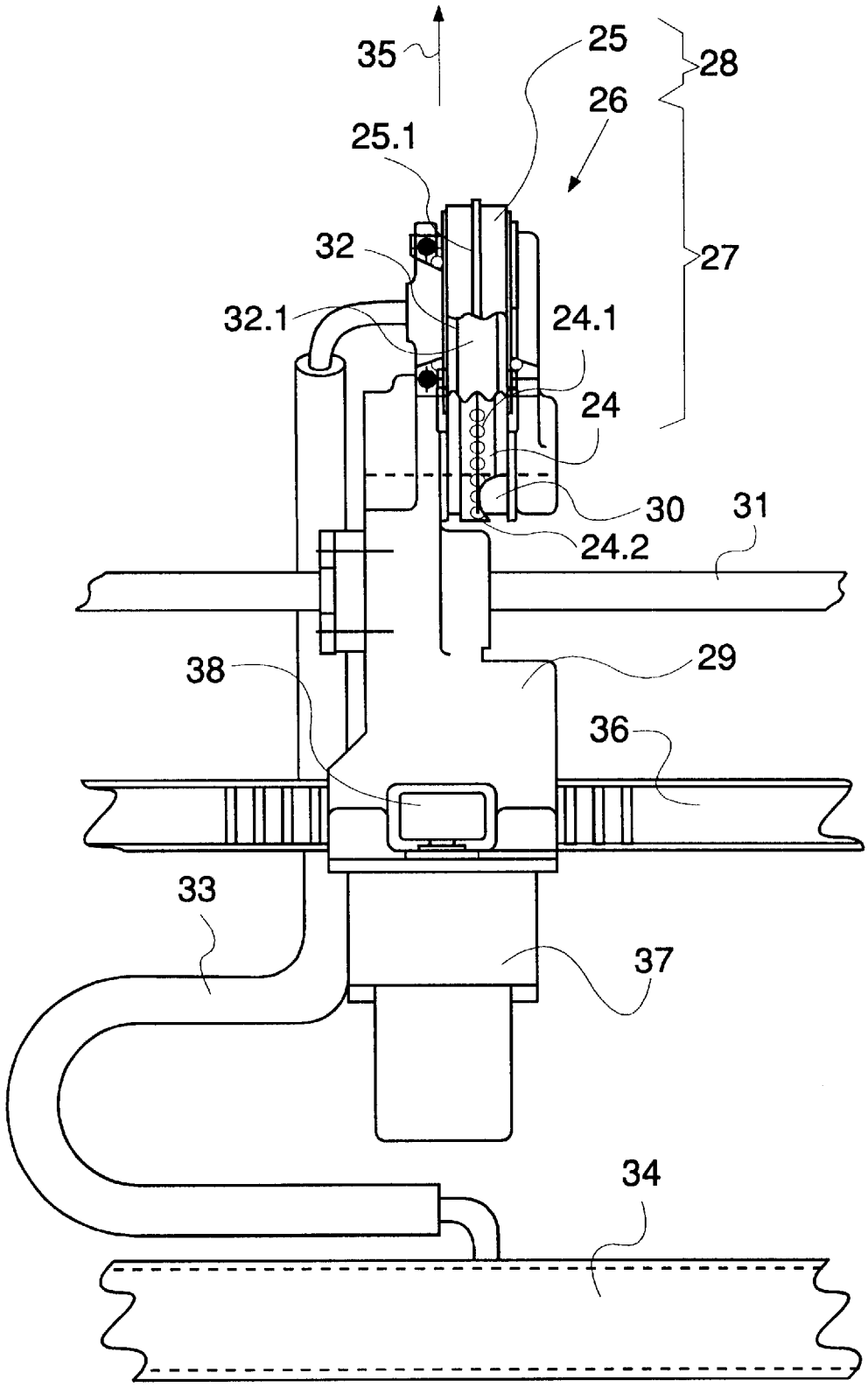
FIG. 2 is a top plan view of an embodiment of a basic functional unit according to the invention, that is illustrated both in changeover conditions forming a sheet brake and a sheet support, respectively.

FIG. 2, which illustrates a detail of the braking station 11 in a top plan view, constitutes an embodiment of a basic functional unit 26 which can selectively be equipped with a braking element 24 or a supporting element 25. By an appropriately broken-away mode of illustration of the braking element 24 and of the supporting element 25, the two changeover or converted conditions corresponding to a sheet brake 27, on the one hand, and to a sheet support 28, on the other hand, are illustrated on one and the same basic functional unit 26.

The braking element 24 is preferably formed as an endless suction belt, and the supporting element 25 as an endless supporting belt having a cross section that forms an elevation 25.1 on the outside of the supporting belt. An appropriate. cross section may have, for example, a triangular shape. In the configuration illustrated in FIG. 2, the cross section forms an elevation or rise 25.1, for supporting the sheets 3, in the form of a web that extends along the supporting belt.

The basic functional unit 26 is formed by a base 29 which, depending upon the changeover condition, provides a mounting for a roller 30 about which the suction belt and the supporting belt, respectively, wrap, and at least one further roller having an axis parallel to the roller 30 and about which the suction belt and the supporting belt, respectively, wrap, at least one of the respective rollers being connected to a drive.

The drive is made up of a drive shaft 31 that passes through the base 29, transversely to the processing direction and, in the embodiment of FIG. 2, drives the roller 30, during operation, via a non-illustrated gear transmission. The cross section of the drive shaft 31 has a shape which differs from that of a circle and, when operating, rotates a drive wheel of the aforementioned gear transmission via a form-locking connection. The form-locking connection is configured so that the base 29 is displaceable relative to the drive shaft 31, in the longitudinal direction of the latter, transversely to the processing direction, in order to adjust the base.

The basic functional unit 26 further includes a suction chamber 32 having a suction opening 32.1 which faces the respective sheet 3 and, in the changeover condition forming the sheet brake 27, is covered by the suction belt constituting the braking element 24 and, when operating, sweeping over the suction chamber 32, up to the suction openings 24.1 provided in the suction belt. The suction chamber 32 is connected via a flexible line 33 to a manifold 34 that, in turn, is connected to a non-illustrated vacuum generator. A vacuum prevailing in the suction chamber 32 during operation passes through the braking element 24, formed as a suction belt, through the suction openings 24.1 provided in the suction belt and thus effects a contact force between the braking element 24 and a respective sheet 3 brought into contact therewith; by this contact force, assuming a peripheral speed of the braking element 24 that is less than the peripheral speed of the gripper systems 9, braking of the respective sheet 3 transferred from one of the gripper systems 9 to the sheet brake 27 can be achieved. It is usual for the peripheral speed of that strand or run of the suction belt constituting the braking element 24, which sweeps over the suction opening 32.1 of the suction chamber 32, to have the same main direction as that of the speed with which a respective sheet 3 is brought up to the braking station 11 by a respective one of the gripper systems 9. The aforementioned main direction is indicated in FIG. 2 by the directional arrow 35.

Because contact between the sheet and the sheet brake 27, in order to brake a sheet 3 printed in the recto/verso or first-form and perfecter printing process, is permissible only within print-free corridors of the sheet 3, in the configuration illustrated in FIG. 2, the suction openings 24.1 in the suction belt which communicate with the suction chamber 32 are provided within the width of a rib 24.2 that is provided on the outside of the suction belt and extends over the length thereof, and the width of the rib 24.2 is matched to the width of the print-free corridors which are usually present, and determines the width of a contact surface between the respective sheet 3 and the braking element 24.

The supporting element 25 which, in a changeover condition constituting the sheet support 28, replaces the braking element 24 and is formed as an endless supporting belt, during operation, sweeps over the suction chamber 32 in the same manner as for the braking element 24 formed as an endless suction belt. However, by contrast with the suction belt, the supporting belt has a full cross section that is unbroken over the entire length thereof and is dimensioned, just like the suction belt, so that when it is assembled, it covers the suction opening 32.1 of the suction chamber 32. The supporting belt constituting the supporting element, therefore, is not traversed by a vacuum which prevails in the suction chamber 32 during operation, but rather, is used only to support the respective sheets 3. To this end, due to the elevation or rise, a sheet supporting surface is formed on the sheet support 28, which has a width that is many times smaller than that of the supporting belt. In particular, the width of the sheet supporting surface is smaller than the width, provided in the configuration according to FIG. 2, of the rib 24.2 of the suction belt that is adapted to the width of print-free corridors which are usually present. In print-free corridors having a width smaller than the width of the contact surface determined by the braking element 24, a respective sheet 3 can thus advantageously be supported by the sheet support 28. A further possible use for the sheet support 28 is to place it, while it is being adjusted transversely to the processing direction, so that the sheet supporting surface makes contact with a respective sheet 3 along a line provided for a fold.

In the configuration presented in FIG. 2, the basic functional unit 26 forming the sheet brake 27 and the sheet support 28, respectively, depending upon the changeover condition, is assigned to a toothed rack 36 extended transversely to the processing direction. In addition, the basic functional unit includes a servo-drive 37, by which a gearwheel 38 cooperating with the rack 36 can be driven, so that the basic functional unit 26 can be adjusted servomotively transversely to the processing direction. The base 29 of the basic functional unit 26 is formed so that the latter is carried by the rack 36 and guided along the latter. A plurality of basic functional units 26 of such a construction, which are connected to the drive shaft 31 and the rack 36 in the manner presented, thus form sheet brakes 27 and sheet supports 28, respectively, depending upon the respective basic functional unit being equipped with the braking element 24 or the supporting element 25, which can be adjusted servomotively transversely to the processing direction.

Figure 3:
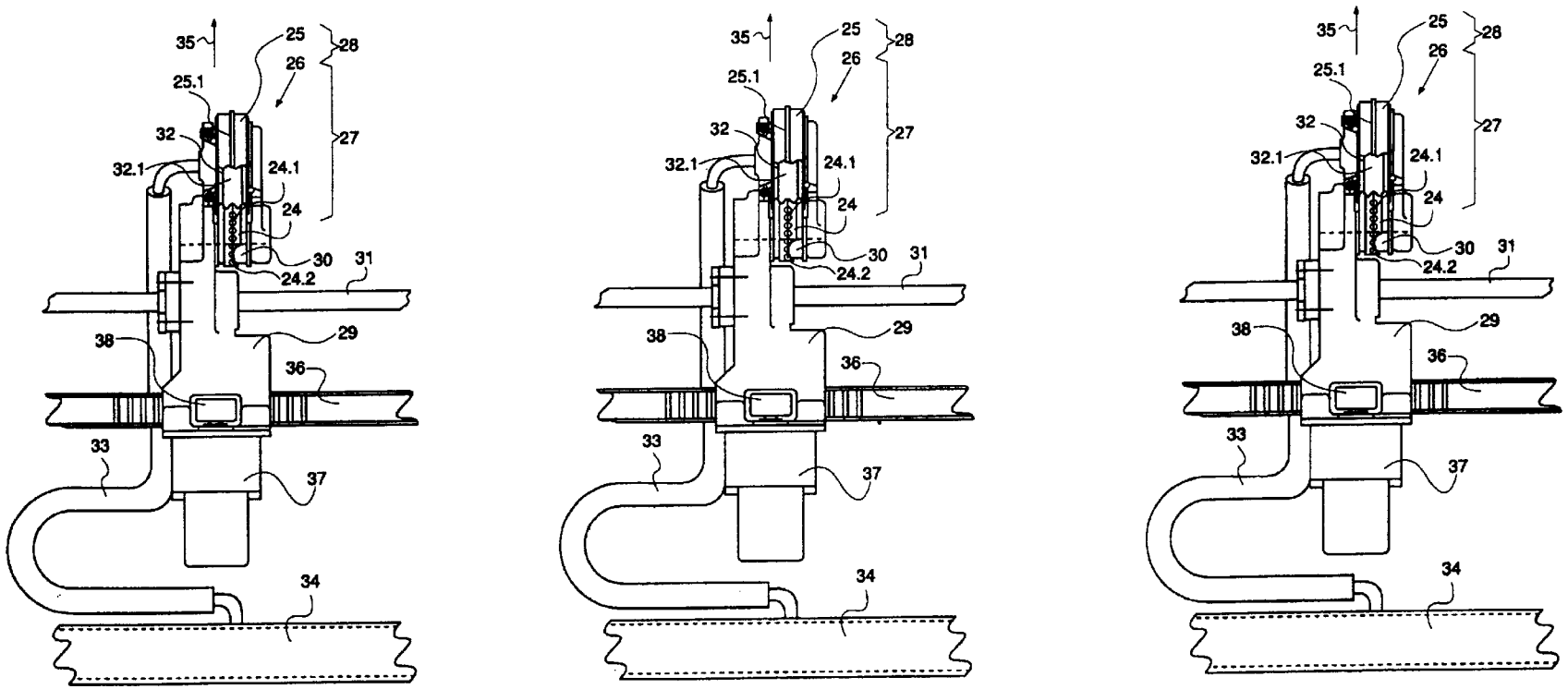
FIG. 3 is a top plan view of a plurality of the basic functional unit of FIG. 2.

FIG. 3 illustrates a plurality of the basic functional unit 26 shown in FIG. 2 and described in the preceding text.

We claim:

1. A delivery for a printing machine processing sheets passing therethrough in a processing direction, comprising:

modular braking elements each:

formed with at least one opening adapted to be connected to a vacuum source; and having a braking insert;

modular supporting elements each having a supporting insert substantially identical to said braking insert; and sheet handling devices each having:

one of a plurality of substantially identical basic driving modules adapted to be connected to the vacuum source and to be selectively displaced transverse to the sheet processing direction, each of said basic driving modules having a receptacle; and a sheet carrying device revolvably disposed on said one basic driving module, said sheet carrying device being one of said elements, a respective one of said braking insert and said supporting insert being removably connected to said receptacle, said braking element adapted to apply a vacuum of the vacuum source to the sheet through said at least one opening, said supporting element preventing application of the vacuum to the sheet.

2. The delivery according to claim 1, including a servomotor assembly connected to said sheet handling devices and servomotively adjusting said sheet handling devices transverse to the sheet processing direction.

3. The delivery according to claim 1, wherein said sheet handling devices servomotively adjust transverse to the sheet processing direction.

4. The delivery according to claim 1, wherein:

each of said braking elements is formed as an endless suction belt;

each of said supporting elements is formed as an endless supporting belt having an outside, said supporting belt having a cross-section forming one of an elevation and rise on said outside.

5. The delivery according to claim 1, wherein a respective one of said braking insert and said supporting insert are interchangeably connected to said receptacle.

6. In combination with a sheet-processing printing machine processing sheets passing therethrough in a processing direction and having a vacuum source providing a vacuum, a delivery comprising:

modular braking elements each:

formed with at least one opening adapted to be connected to the vacuum source; and having a braking insert;

modular supporting elements each having a supporting insert substantially identical to said braking insert; and sheet handling devices each having;

one of a plurality of substantially identical basic driving modules connected to the vacuum source and selectively displaced transverse to the sheet processing direction, each of said basic driving modules having a receptacle; and a sheet carrying device revolvably disposed on said one basic driving module, said sheet carrying device being one of said elements, a respective one of said braking insert and said supporting insert being removably connected to said receptacle, said braking element applying the vacuum of the vacuum source to the sheet through said at least one opening, said supporting element preventing application of the vacuum to the sheet.

7. The delivery according to claim 6, wherein a respective one of said braking insert and said supporting insert are interchangeably connected to said receptacle.

8. A delivery for a printing machine processing sheets passing therethrough in a sheet processing direction, comprising:

modular braking elements each:

formed with at least one opening adapted to be connected to a vacuum source; and having a braking insert;

modular supporting elements each having a supporting insert substantially identical to said braking insert; and a plurality of sheet handling devices adapted to be connected to the vacuum source and to be selectively displaced transverse to the sheet processing direction, each of said sheet handling devices having:

one of a plurality of substantially identical basic driving modules each having a receptacle; and a sheet carrying device revolvably disposed on said one basic driving module, said sheet carrying device being one of said elements, a respective one of said braking insert and said supporting insert being removably connected to said receptacle, said braking element adapted to apply a vacuum of the vacuum source to the sheet through said at least one opening, said supporting element preventing application of the vacuum to the sheet.

9. The delivery according to claim 8, wherein:

each of said braking elements is formed as an endless suction belt; and each of said supporting elements is formed as an endless supporting belt having an outside, said supporting belt having a cross section forming an elevation on said outside.

10. The delivery according to claim 8, wherein said sheet handling devices servomotively adjust transverse to the sheet processing direction.

11. The delivery according to claim 8, including a servomotor assembly connected to said sheet handling devices and servomotively adjusting said sheet handling devices transverse to the sheet processing direction.

12. The delivery according to claim 8, wherein a respective one of said braking insert and said supporting insert are interchangeably connected to said receptacle.

13. In combination with a sheet-processing printing machine processing sheets passing therethrough in a processing direction and having a vacuum source providing a vacuum, a delivery comprising:

modular braking elements each:

formed with at least one opening adapted to be connected to a vacuum source; and having a braking insert;

modular supporting elements each having a supporting insert substantially identical to said braking insert; and a plurality of sheet handling devices connected to the vacuum source and selectively displaced transverse to the sheet processing direction, each of said sheet handling devices having:

one of a plurality of substantially identical basic driving modules each having a receptacle; and a sheet carrying device revolvably disposed on said one basic driving module, said sheet carrying device being one of said elements, a respective one of said braking insert and said supporting insert being removably connected to said receptacle, said braking element applying the vacuum to the sheet through said at least one opening, said supporting element preventing application of the vacuum to the sheet.

14. The delivery according to claim 13, wherein a respective one of said braking insert and said supporting insert are interchangeably connected to said receptacle.

* * * * *